US005333552A

United States Patent [19]

Corzine et al.

[11] Patent Number: 5,333,552

[45] Date of Patent: Aug. 2, 1994

[54] HUNTING BULLET WITH REINFORCED CORE

[75] Inventors: Alan J. Corzine, Marine; Gerald E. Eberhart, Bethalto, both of Ill.

[73] Assignee: Olin Corporation, East Alton, Ill.

[21] Appl. No.: 56,146

[22] Filed: Apr. 30, 1993

[51] Int. Cl.[5] ..... F42B 12/34

[52] U.S. Cl. ..... 102/509; 102/517

[58] Field of Search ..... 102/507, 508, 509, 510, 102/517

[56] References Cited

U.S. PATENT DOCUMENTS

| | | | |
|---|---|---|---|
| 1,468,113 | 9/1923 | Johnsen | 102/507 |
| 2,682,224 | 6/1954 | Braverman | 102/507 |
| 2,792,618 | 5/1957 | Walker | 102/507 |
| 2,932,253 | 4/1960 | Auxier | 102/507 |
| 2,958,287 | 11/1960 | Auxier | 102/507 |
| 3,003,420 | 10/1961 | Nosler | 102/508 |
| 4,655,140 | 4/1987 | Schirneker | 102/508 |
| 5,127,332 | 7/1992 | Corzine et al. | 102/509 |

*Primary Examiner*—David H. Brown

*Attorney, Agent, or Firm*—Gregory S. Rosenblatt

[57] ABSTRACT

A controlled expanding small caliber bullet is disclosed which comprises a partition-type bullet with an empty hollow point, a rear cavity filled with a dense core and a high strength insert between the core and the body in the forward portion of the rear cavity.

10 Claims, 2 Drawing Sheets

HUNTING BULLET WITH REINFORCED CORE

BACKGROUND OF THE INVENTION

1. Cross-Reference to Related Applications

This is an original application.

2. Field of Invention

This invention relates generally to hunting bullets and more particularly to hollow point bullets.

3. Description of the Related Art

Hunting bullets are generally small caliber, i.e. less than 0.50 caliber. They generally have a hollow point or soft metal nose portion to increase expansion of the bullet upon impact with animal tissue in order to achieve increased energy adsorption within the target animal's body. Lead hollow point bullets have a significant drawback for use in hunting applications. They tend to upset and expand greatly within a short penetration distance and are thus not suitable for deep penetration. This is particularly true where the bullet hits a bone during passage into the animal. Hunters often aim for the shoulder area of the target animal in order to minimize the chance of the animal escaping after it has been shot and because the vital organs of the animal are in the same general area of the animal as the shoulder. However, lead bullets have an advantage due to their higher density which promotes penetration. Expansion of the bullet is desirable to slow the bullet and transfer more energy to the target during passage through soft animal tissue. If the bullet does not expand significantly and does not hit a bone or vital organ, it may pass through the animal without killing the animal or stopping the animal. For the bullet to successfully pass through animal bone and still do damage to vital organs, it is necessary that the bullet have density, sufficient structural integrity and retained weight.

One hunting bullet which addresses some of the above needs is that disclosed in our prior U.S. Pat. No. 5,127,332, which is incorporated by reference in its entirety herein. The patent discloses a unitary metal body of generally H shaped longitudinal cross section with an empty hollow point in front and a rear cavity filled with a dense material such as lead. The rear cavity was closed by a disk to seal the lead from the environment. This bullet has several advantages and and disadvantage. One advantage is that it has good weight retention due to the lead being confined to the rear cavity so the bullet does not lose a significant part of its weight if the petals in the front break off during penetrations of the target, since the front hollow point portion of the bullet is relatively light in comparison to the dense solid rear portion of the bullet. Another advantage is that the forward part of the side walls of the rear cavity of the bullet tend to bulge due to the forward inertia and kinetic energy of the heavy lead core during the rapid deceleration upon impact. The bulge helps in making a larger wound channel. The disadvantage of this bullet is that it has been found to break apart when it hits heavy bones at near muzzle velocity.

An improvement is needed in order to achieve the advantages of the bullet of our prior U.S. Pat. No. 5,127,332 without the disadvantage.

SUMMARY OF THE INVENTION

Brief Technical Description

The problem is solved by the bullet of the present invention described and claimed below in which a high tensile strength thin liner is placed in the forward portion of the rear cavity to prevent side wall rupture. In the preferred form of the invention, the partition has enough thickness to prevent the rear core punching through the partition upon rapid deceleration, and it was found that the insert should have a length sufficient to protect against side wall puncture by petals formed from the rearward petaling of the hollow point.

BRIEF DESCRIPTION OF THE DRAWINGS

The invention will be better understood by reference to the enclosed drawing in which.

DETAILED DESCRIPTION OF THE INVENTION

Technical Basis For The Invention

The invention stems from a thorough understanding of the manner in which hunting bullets are made and used. In particular, the fact of occasional lack of bullet penetration had to be recognized. Next, the lack of penetration had to attributed to bullet break up. Then the reason for break up of the bullet of our prior U.S. Pat. No. 5,127,332 had to be determined and a solution determined that was economical to manufacture but yet retained the advantages of the bullet (increased density and good deceleration in soft tissue and reasonable chamber pressures on firing). The metal in the bullet body is stronger than bone, so it was determined that the bullet itself must be strengthened in the area of failure but that area is not obvious. We recognized that the deceleration of the bullet upon bone impact was so sudden that the rear core was rupturing the sidewalls of the cavity. However, we found that thickening the sidewalls reduced the bullet density too much to achieve the increased penetration relative to other available bullets and that bullet break up still occured. During one test, to our great surprise, we found a hollow point petal "speared" right through the front part side wall in the location shown in FIG. 4 at reference number 56. We tried just putting a deflanged 209 primer cup into the rear cavity and amazingly the bullet resisted failure but retained rearly 90% of its weight. Repeated testing demonstrated that with this seemingly simple modification, the bullet was now surprisingly and unexpectedly achieving the desired superior penetration through either bone or soft tissue. This bullet is the soon to be produced Winchester ® Black Talon ® centerfire rifle cartridge.

Preferred Embodiments

Figure 1:
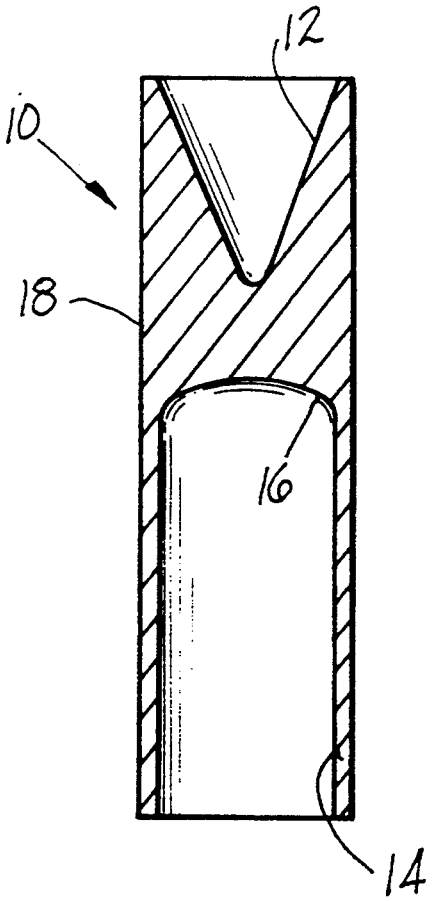
FIG. 1 is an axial cross sectional view of a preferred bullet body preform for the bullet of FIG. 3.
Figure 2:
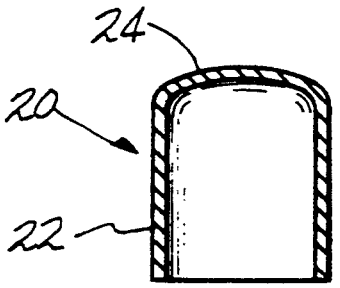
FIG. 2 is an axial cross sectional view of a preferred insert for the bullet of FIG. 3.

A controlled expanding or mushrooming small caliber bullet constructed in accordance with the present invention is illustrated in FIG. 1–4. Referring first to FIG. 1, a cylindrical tubular bullet body preform 10 is shown with a forwardly open, rearwardly tapered front recess 12 and a rearwardly open cylindrical rear recess or cavity 14 with a generally rounded transverse wall or "partition" 16. Preform 10 is preferably made of a copper alloy. Recess 12, cavity 14 and partition 16 are tandemly arranged along a central axis of the tubular preform. FIG. 2 shows a cup-shaped tubular insert 20 having a cylindrical side wall 22 and a concave base 24. The outer diameter of insert 20 is slightly less than the inner diameter of cavity 14 of preform 10. Base 24 conforms to the rear surface of partition 16.

Figure 3:
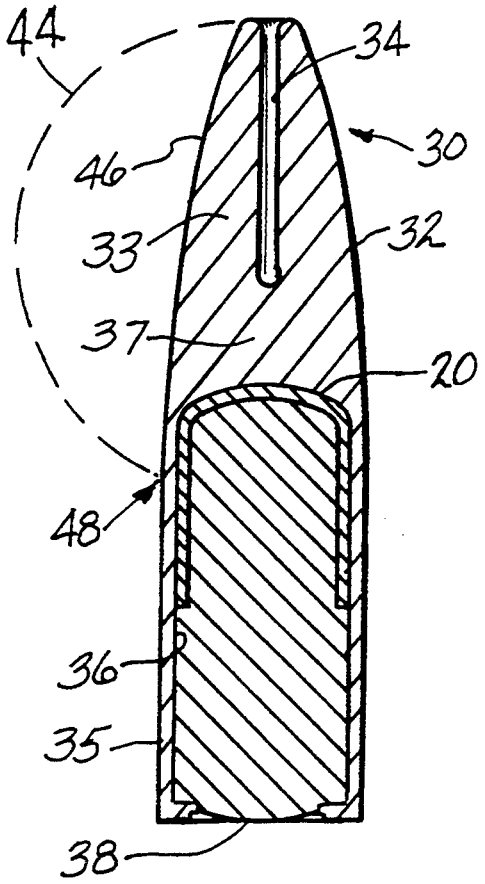
FIG. 3 is an axial cross sectional view of a bullet constructed in accordance with the present invention.

FIG. 3 shows the preferred bullet of the invention in the configuration it would generally have for a 0.300 Winchester Magnum 180 grain centerfire rifle bullet. Minor dimensional modifications would be made for other calibers of bullets. Bullet 30 has a unitary metal body 32 of generally H-shaped axial cross section with an ogival nose portion 33 containing a front recess 34 in the form of a rearwardly extending forwardly open central blind bore, a heel portion 35 containing a rear cavity 36 and a partition therebetween. "Partition" merely refers to the material which lies between a rear end or "bottom" of recess 34 and a front end or "bottom" of rear cavity 36. Bullet 30 is formed by inserting insert 20 fully into rear cavity 36 of preform 10 and (illustrated in FIG. 1) then inserting a lead core 38 into rear cavity 36 and into insert 20 (or inserting the core into the insert and then inserting the combined core and insert into rear cavity 36) and then deforming the combined preform, insert and core to form bullet 30.

In one embodiment of the invention, the axial length of the partition 37 is greater than the thickness of the insert 20.

Figure 5:
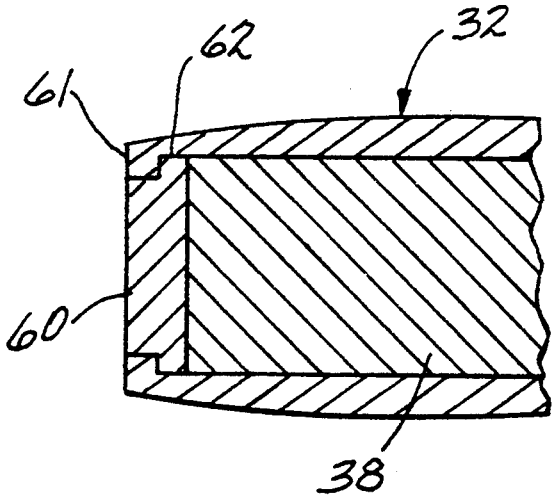
FIG. 5 is an axial cross-sectional view of the bullet of FIG. 3 further including a closure disk.

In another embodiment of the invention, as illustrated in FIG. 5, a closure disk 60 is positioned behind the core 38 to seal the core from the environment. The core 38 may be made from lead or powdered tungsten particles which may be held together as a suitable body by a suitable binder such as plastic. The rim 61 of the bullet body 32 is crimped over a radially outward extending flange portion 62 of the closure disk 60 to enclose the core 38. The disk 60 may simply be a flat disk having a radially outward extending annular flange engaging an inwardly crimped annular rim of the heel portion to lock the core material and the disk to the metal body. The disk 60 is preferably made from the same material as the metal body 32 to minimize the chance of forming a galvanic cell which could promote corrosion of the bullet body 32 and/or the core material 38 and adversely affect the propellant in the cartridge case. Alternatively, the disk 60 may be made of a non-conductive material such as plastic.

In another embodiment of the invention, the axial length of the blind bore 34 is greater than the diameter of the bullet, but less than 1.5 times the sum of the axial lengths of the partition 37 and the insert 20.

In yet another embodiment, the diameter of the rear cavity 36 is more than 4 times as large as the diameter of the blind bore 34.

Preferred Mode of Operation

Figure 4:
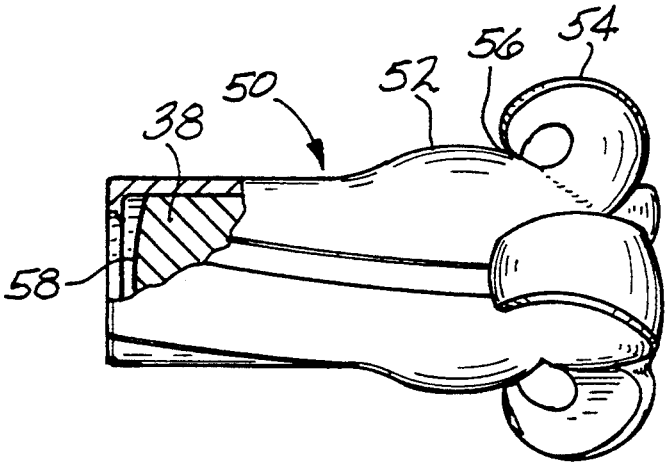
FIG. 4 is a side view in partial cross section of the bullet of FIG. 3 after impact with soft animal tissue.

In operation, the bullet is assembled as noted above and then loaded into a primed cartridge case along with the desired amount of propellant to produce a loaded ammunition round such as a "Winchester Black Talon Fail Safe Supreme" brand 0.300 Winchester Magnum caliber centerfire rifle cartridge. The cartridge is then loaded into the appropriate rifle and fired at a desired target such as a deer or elk. If the bullet passes through soft animal tissue, the petals 46 tend to fold back along a path such as 44 until they come into contact with a point 48 on the outer wall of the bullet surrounding rear cavity 36. The configuration of the "upset" bullet after a typical impact with soft animal tissue (or ordnance gelatin) is depicted in FIG. 4, although the petals would normally lie at an angle relative to the bullet axis due to rotational forces from the deceleration of the spinning bullet upon such impact. Upset bullet 50 has a bulge 52, upset petals 54 with tips 56 and the core 38 has moved forwardly to line 58 due to the forward momentum of the dense core and the rearward external drag on the body 32. Referring to FIG. 3 and FIG. 4, bulge 52 is a potential source of bullet failure which is prevented due to the higher tensile strength of insert 20 than body 32. The softness and engravability of a copper alloy body is preferred to prevent excess chamber pressures that would be expected if the body was made of steel. The petal tips 56 can also be a source of bullet failure if the petals lie in the configuration in FIG. 4 and if the side wall of the body and insert are of insufficient hardness. The failure in such a situation would be due to the petals spearing through the body and allowing the lead core to extrude out. Insert 20 serves to greatly reduce the likelihood of that occuring because the insert is stronger than the petals-54, so the petals tend to deform further or break off rather than penetrate to the insert. 1008 steel has been found to be a suitable material for insert 20. Because large axial forces can be put on the front of bullet 30 if it hits a bone or other hard object, the insert is desired to prevent failure of the wall of cavity 36. The petaling of the front portion of the bullet 30 to form a much larger diameter front to the bullet is needed to slow the bullet down if it does not hit a bone or other hard object in the target. The deceleration in soft animal tissue is due to increased drag due to the greatly increased diameter. The petals slow down the bullet the desired amount in soft animal tissue to achieve the desired depth of penetration. The desired depth of penetration is usually the full thickness of the animal and just a little more, so that the bullet will exit the far side with only minimal velocity (for safety reasons and since any kinetic energy remaining on exit is not transferred to the animal and is thus normally wasted).

MODIFICATIONS AND INCORPORATIONS BY REFERENCE

Modifications

While the invention has been described above and below with references to preferred embodiments and specific examples, it is apparent that many changes, modifications and variations in the materials, arrangements of parts and steps can be made without departing from the inventive concept disclosed herein.

Accordingly, the spirit and broad scope of the appended claims is intended to embrace all such changes, modifications and variations that may occur to one of skill in the art upon a reading of the disclosure.

We claim:

1. A controlled expanding small caliber bullet, comprising:

a unitary metal body of generally H-shaped axial cross section having an ogival nose portion, a generally cylindrical heel portion behind said nose portion and an integral partition therebetween along a central axis therethrough, said nose portion having an empty hollow point formed by a rearwardly extending forwardly open central bore and said heel portion having a rearwardly open cavity therein;

a dense core filling the rear cavity and of a material more dense and of lower tensile strength than said metal body; and a tubular metal insert of higher tensile strength than the metal body located in at least the forward portion of the rear cavity between the dense core and the integral partition.

2. The bullet according to claim 1 wherein the insert is located in only the forward portion of the rear cavity.

3. The bullet according to claim 1 wherein the axial length of the blind bore is greater than the diameter of the bullet but less than 1.5 times the sum of the axial lengths of the partition and the insert.

4. The bullet according to claim 1 wherein the diameter of the rear cavity is more than four times as large as the diameter of the blind bore.

5. The bullet of claim 1 wherein the tubular insert has a closed forward end disposed between, and conforming to, a front surface of the core and a rear surface of the partition.

6. The bullet according to claim 1 wherein the body is a copper alloy.

7. The bullet according to claim 2 wherein the insert is steel.

8. The bullet according to claim 1 wherein said metal body is a copper alloy and said dense core is lead.

9. The bullet according to claim 4 wherein the axial length of the partition is greater than the thickness of the insert.

10. The bullet according to claim 9 wherein a closure disk having a radially outward extending annular flange engaging an inwardly crimped annular rim of said heel portion seals said dense material within said metal body.

* * * * *